US012575600B2

(12) United States Patent
Setzer

(10) Patent No.: US 12,575,600 B2
(45) Date of Patent: Mar. 17, 2026

(54) DEVICE FOR FILTERING SMOKE

(71) Applicant: Andreas Setzer, Vienna (AT)

(72) Inventor: Andreas Setzer, Vienna (AT)

( * ) Notice: Subject to any disclaimer, the term of this patent is extended or adjusted under 35 U.S.C. 154(b) by 379 days.

(21) Appl. No.: 18/044,960

(22) PCT Filed: Sep. 10, 2021

(86) PCT No.: PCT/EP2021/074904
§ 371 (c)(1),
(2) Date: Mar. 10, 2023

(87) PCT Pub. No.: WO2022/053597
PCT Pub. Date: Mar. 17, 2022

(65) Prior Publication Data

US 2023/0354887 A1 Nov. 9, 2023

(30) Foreign Application Priority Data

Sep. 10, 2020 (EP) ..... 20195458

(51) Int. Cl.
*A24D 3/04* (2006.01)
*A24D 1/04* (2006.01)
(Continued)

(52) U.S. Cl.
CPC ..... *A24D 3/04* (2013.01); *A24D 1/045* (2013.01); *A24D 3/063* (2013.01); *A24D 3/066* (2013.01); *A24D 3/10* (2013.01); *A24D 3/163* (2013.01)

(58) Field of Classification Search
None
See application file for complete search history.

(56) References Cited

U.S. PATENT DOCUMENTS 3,236,244 A * 2/1966 Irby, Jr. ..... A24D 3/14 131/342
3,547,009 A 12/1970 Molins
(Continued)

FOREIGN PATENT DOCUMENTS

| | | | |
|---|---|---|---|
| EP | 0658320 | A2 | 6/1995 |
| EP | 1413212 | A1 | 4/2004 |
| WO | 2017132709 | A1 | 8/2017 |

OTHER PUBLICATIONS

ISA European Patent Office, International Search Report Issued in Application No. PCT/EP2021/074904, Nov. 10, 2021, WIPO, 5 pages.

*Primary Examiner* — Dennis R Cordray
(74) *Attorney, Agent, or Firm* — McCoy Russell LLP

(57) ABSTRACT

A device for filtering smoke, in particular tobacco and/or cannabis cigarette filters, comprising a jacket, in which jacket there are provided at least a first portion, a second portion and a third portion, the second portion being arranged between the first portion and the third portion, wherein in the first section a first nonwoven filter material, in the second section a porous filter material, and in the third section a second nonwoven filter material being provided in the third section; wherein a fourth section is provided in the jacket, wherein the third section is arranged between the second section and the fourth section, and wherein the fourth section is arranged such that, when flowing through the jacket, a pressure drop across the fourth section is lower than a pressure drop across the third section.

16 Claims, 1 Drawing Sheet

(51) Int. Cl.

| | |
|---|---|
| ***A24D 3/06*** | (2006.01) |
| ***A24D 3/10*** | (2006.01) |
| ***A24D 3/16*** | (2006.01) |

(56) References Cited

U.S. PATENT DOCUMENTS

| | | | | |
|---|---|---|---|---|
| 3,658,069 | A | 4/1972 | Wise et al. | |
| 8,408,216 | B2 * | 4/2013 | Luan | A24D 3/166 131/342 |
| 2003/0106562 | A1 | 6/2003 | Chatterjee | |
| 2006/0130861 | A1 | 6/2006 | Luan et al. | |
| 2010/0108085 | A1 * | 5/2010 | Duke | A24D 3/04 131/339 |
| 2011/0005534 | A1 * | 1/2011 | Albino | A24D 1/00 131/202 |

* cited by examiner

DEVICE FOR FILTERING SMOKE

CROSS-REFERENCE TO RELATED APPLICATIONS

The present application is a U.S. National Phase of International Application No. PCT/EP2021/074904 entitled "DEVICE FOR FILTERING SMOKE," and filed on Sep. 10, 2021. International Application No. PCT/EP2021/074904 claims priority to European Patent Application No. 20195458.3 filed on Sep. 10, 2020. The entire contents of each of the above-listed applications are hereby incorporated by reference for all purposes.

TECHNICAL FIELD

The invention relates to a device for filtering smoke, in particular a tobacco and/or cannabis cigarette filter, comprising a wrap, wherein at least a first section, a second section and a third section are provided in the wrap, wherein the second section is disposed between the first section and the third section, wherein

- a first nonwoven filter material is provided in the first section,
- a porous filter material is provided in the second section, and
- a second nonwoven filter material is provided in the third section.

BACKGROUND AND SUMMARY

Conventional cigarette filters often have only a cellulose acetate filter. Filters are also known in which activated carbon is provided between two ceramic disks. In this case, the ceramic disks have holes for the air flow. By providing activated carbon as a filter, a higher percentage of toxins such as tar and aromatics can be filtered out of the smoke. However, disadvantageously, activated carbon dust can also penetrate through the holes in the ceramic discs and thus be inhaled by a person who is smoking.

In addition, US 2003/0106562 A1 discloses a filter cigarette with three sections. The first section contains cellulose acetate fibers as the mouthpiece, the second section contains activated carbon, and the third section again contains cellulose acetate fibers as a barrier between activated carbon and tobacco. Disadvantageously, the draught through the cigarette filter is severely reduced in these filter cigarettes. Furthermore, cooling of the smoke prior to inhalation by a person who is smoking is not possible and the taste is adversely affected. Disadvantageously, the cigarette filters with three sections that are known in the art are also not suitable for use with cannabis cigarettes or tobacco-cannabis cigarettes due to their insufficient length or filtration performance.

An objective of the invention is to alleviate or eliminate one or more disadvantages of the prior art. In particular, an objective of the invention is to propose a device for filtering smoke that has less adverse effect on the passage through the device and achieves good filtering performance. Preferably, cooling of the smoke is enabled and taste is less adversely affected. Preferably, a device for filtering smoke suitable for use with cannabis cigarettes or tobacco-cannabis cigarettes is proposed.

This is achieved by a device for filtering smoke as mentioned at the outset, wherein a fourth section is provided in the wrap, wherein the third section is disposed between the second section and the fourth section, and wherein the fourth section is disposed in a manner such that, when a flow passes through the wrap, a pressure drop over the fourth section is smaller than a pressure drop over the third section.

By providing a fourth section in which there is a lower pressure drop when a flow passes through the device, in particular through the wrap, than in the third section, the draught through the device is improved. In particular, the fourth section enables the smoke to be cooled without deteriorating the draught. At the same time, desired flavor substances are thus transported better through the device. With the help of the fourth section, a greater length can also be obtained without deteriorating the draught. This also improves the feel.

Mainly tar, nicotine and condensates are filtered out of the smoke with the first nonwoven filter material. Mainly aromatic compounds, para-benzoquinone and carbonyl compounds (especially acetaldehydes, acetones, acrolein, crotonaldehydes, propionaldehydes) are filtered out of the smoke with the porous filter material. The second nonwoven filter material is primarily used to filter dust (for example, activated carbon dust) carried by the flow from the porous filter material. Advantageously, the second nonwoven filter material filters only a small quantity of flavor substances from the smoke (especially compared with the first nonwoven filter material, which serves for primary filtration of the smoke).

The wrap borders/surrounds the first, second, third and fourth sections in the radial direction. Preferably, the wrap forms a closed envelope (in the radial direction) from the end (facing away from the fourth section) of the first section to the end (facing away from the first section) of the fourth section. The wrap preferably has bleached and/or unbleached paper (in particular in a thickness of between 60 and 100 mg/m$^2$). The wrap is preferably open in the direction of the two bases. The term "one end" should be understood to mean an end face in the axial direction. Preferably, the wrap is in the shape of a surface of revolution. In particular, the wrap has the shape of the curved surface of a straight circular cylinder, or it is in the form of a hollow cylinder. The wrap is preferably formed by a filter wrap paper. The wrap has a wall thickness (in the radial direction) that preferably less than 0.5 mm, particularly preferably less than 0.2 mm. The wrap has a diameter that is preferably between 3 mm and 15 mm, particularly preferably between 5 mm and 8 mm, yet more preferably between 6 mm and 7 mm, in particular substantially 6.4 mm. The axial direction of the wrap passes through the wrap and is orthogonal to the radial direction of the wrap. The axial or radial direction of the device and the sections corresponds to the axial or radial direction of the wrap. The axial direction of the device is the longitudinal direction of the device.

At least one substance, in particular a pollutant, is filtered out of the smoke as it flows through the device, in particular through the wrapper. In particular, the smoke is the smoke produced when smoking a cigarette. In the context of the present disclosure, a cigarette may contain tobacco and/or cannabis and/or other substances which can be smoked.

The disposition of the sections in the axial direction is in the following order in particular: first section, then second section, then third section, then fourth section. The fourth section is preferably the section near the mouth and the first section is the section far from the mouth. The first and second sections are preferably directly adjacent to each other. The second and third sections are preferably directly adjacent to each other. The third and fourth sections are preferably directly adjacent to each other. The first section has a length in the axial direction that is preferably between 3 and 14 mm, particularly preferably between 5 and 10 mm, yet more preferably between 6 and 8 mm, in particular substantially 7 mm. The second section has a length in the axial direction that is preferably between 4 and 20 mm, particularly preferably between 6 and 15 mm, yet more preferably between 8 and 12 mm, in particular substantially 9 mm. The third section has a length in the axial direction that is preferably between 3 and 14 mm, particularly preferably between 5 and 10 mm, yet more preferably between 6 and 8 mm, in particular substantially 7 mm. The fourth section has a length in the axial direction that is preferably between 3 and 14 mm, particularly preferably between 5 and 10 mm, yet more preferably between 6 and 8 mm, in particular substantially 7 mm.

In particular, the first nonwoven filter material is present in the form of a cylindrical filter. In particular, the second nonwoven filter material is present in the form of a (further) cylindrical filter. The first nonwoven filter material preferably substantially fills the first section. The second nonwoven filter material preferably substantially fills the third section. Preferably, the entirety of the first nonwoven filter material lies against the first section. Preferably, the entirety of the second nonwoven filter material lies against the third section. In particular, the porous filter material is present in the second section as a granular porous filter material. This means that the porous filter material is preferably a granular material. Preferably, the second section is bounded by the first nonwoven filter material and the second nonwoven filter material, respectively, in the axial direction.

In particular, the flow is the flow of smoke. In particular, the flow is produced by generating a negative pressure at the end of the wrap that is closer to the fourth section than to the first section. The flow flows from the end of the wrap that is closer to the fourth section to the end of the wrap that is closer to the first section. The term "pressure drop over a section" should be understood to mean the difference of the pressure in front of the respective section (upstream) minus the pressure behind the respective section (downstream). In particular, the pressure drop is determined in accordance with ISO 6565:2015. The pressure drop over the fourth section is preferably less than 0.5 times, particularly preferably less than 0.2 times, yet more preferably less than 0.1 times the pressure drop over the third section. Preferably, the third section and the fourth section are configured in a manner such that a pressure drop over the fourth section is smaller than a pressure drop over the third section when a flow passes through the wrap. The pressure drop over the fourth section is preferably less than 10 mm WC, more preferably less than 5 mm WC, yet more preferably less than 1 mm WC. 1 mm WC (mm water column) corresponds to 9.8067 Pa.

The problem discussed above is also solved by a device for filtering smoke as mentioned at the beginning, wherein a fourth section is provided in the wrap, wherein the third section is disposed between the second section and the fourth section, and wherein the fourth section comprises a cavity extending from the end of the fourth section facing the third section to the end of the fourth section facing away from the third section. The preferred embodiments discussed in this disclosure may also be provided in the device described in this paragraph.

Advantageously, the fourth section includes a cavity extending from the end of the fourth section facing the third section to the end of the fourth section facing away from the third section. In particular, the cavity is open to the outside. The cavity has a cross-sectional area (orthogonal to the axial direction) that is preferably between 10% and 90%, particularly preferably between 20% and 80%, yet more preferably between 40% and 70% of the cross-sectional area of the (entire) fourth section in the wrap. Thus, a greater length can be obtained for the device in a simple manner without deteriorating the draught. In particular, cooling of smoke is obtained in a simple manner thereby. The cavity preferably has a cross-section which is constant in the axial direction. The cavity is preferably circular in cross-section. The cavity is preferably cylindrical in shape.

Advantageously, the fourth section has a support element that supports the wrap in the region of the fourth section. The support element improves the stability of the device in the region of the fourth section and prevents the wrap from being pushed inwards in the region of the fourth section when the device is held normally. Preferably, an outer surface of the support element is adjacent to an inner surface of the wrap, in particular along the entire length of the fourth section. Preferably, the support element forms the cavity. Preferably, the support element extends along the entire length of the fourth section (in the axial direction). Preferably, the support element comprises bleached and/or unbleached cellulose acetate fibers, plastic, paper and/or cardboard. The support element preferably has a mass density that is greater than the mass density of the first nonwoven filter material and/or the second nonwoven filter material, and is preferably at least 1.5 times the mass density of the first nonwoven filter material and/or the second nonwoven filter material.

Advantageously, the shape of the support element is a hollow cylinder. Thus, smoke can flow through the hole in the hollow cylinder while the wrap is supported.

Advantageously, the fourth section has a length in the longitudinal direction of the device of at least 2 mm, preferably at least 4 mm, particularly preferably at least 6 mm. In particular, the fourth section has a length in the longitudinal direction of the device of substantially 7 mm. Thus, improved cooling of the smoke can be obtained.

Advantageously, an inner wrap is provided inside the wrap that extends over the first section, the second section and the third section, wherein the first nonwoven filter material, the porous filter material, and the second nonwoven filter material are disposed within the inner wrap. Preferably, the first nonwoven filter material and the second nonwoven filter material are at least partially circumferentially bonded to the inner wrap. This can provide better filtration and, for example, prevent activated carbon dust from passing beyond the second nonwoven filter material and thus out of the wrap where the dust would be inhaled by a person who is smoking. Furthermore, this may simplify manufacture of the device, because the inner wrap together with the first and second nonwoven filter materials enclose the porous filter material. The inner wrap can then easily be placed within the wrap. Preferably, the inner wrap has a cylindrical curved surface or is in the shape of a hollow cylinder. Preferably, an outer surface of the inner wrap is bonded, at least in places, to an inner surface of the wrap. In particular, full circumferential bonding is provided in at least one axial position. Preferably, the inner wrap is bonded to the wrap in at least one circumferential section along the entire length of the inner wrap (in the axial direction).

Advantageously, the first section and the third section are configured in a manner such that, in the event of flow through the wrap, a pressure drop over the first section is greater than the pressure drop over the third section. In this manner, good filtration performance can be obtained in the first section, whereas the third section allows as many flavor substances as possible to pass through. In particular, the first section should filter a large proportion of the tar contained in the smoke. The pressure drop over the third section is preferably between 10 and 30 mm WC, particularly preferably between 15 and 25 mm WC. The pressure drop over the first section is preferably between 30 and 60 mm WC, particularly preferably between 35 and 45 mm WC.

Advantageously, the pressure drop over the first section is at least 1.2 times, preferably at least 1.5 times, particularly preferably 1.8 times the pressure drop over the third section. In particular, the pressure drop over the first section is twice the pressure drop over the third section. Thus, a ratio is obtained in which the draught is impeded as little as possible, while the first nonwoven filter material filters as much tar as possible from the smoke.

Advantageously, a pressure drop per unit length in the first section is greater than a pressure drop per unit length in the third section. Thus, advantageously, the first section and the third section may have comparable lengths, wherein the pressure drop over the third section is lower than the pressure drop over the first section. The pressure drop per unit length in a section is the pressure drop over the section divided by the length of the section. The pressure drop per unit length in the first section is preferably at least 1.2 times, more preferably at least 1.5 times, yet more preferably 1.8 times the pressure drop per unit length over the third section.

Advantageously, the first nonwoven filter material has a greater density (i.e., mass density) than the second nonwoven filter material. The density of the first nonwoven filter material is preferably more than 1.1 times, more preferably more than 1.4 times, yet more preferably more than 1.8 times the density of the second nonwoven filter material. Thus, the first nonwoven filter material is also more stable than second nonwoven filter material. Because of the higher density, the first nonwoven filter material is in particular also more heat resistant than the second nonwoven filter material. This is advantageous because the first section is preferably further from the mouth than the third section, and therefore the smoke flowing through the first section is hotter.

Advantageously, between 60 and 140 mg, preferably between 75 and 125 mg, particularly preferably between 85 and 115 mg of the porous filter material is provided in the second section. In particular, substantially 100 mg of the porous filter material is provided in the second section. As a result, particularly good filtration of pollutants out of the smoke can occur, while the negative influence on the draught or the flavor is limited. Preferably, only the second section has the porous filter material.

Preferably, the first nonwoven filter material comprises bleached and/or unbleached cellulose acetate. In particular, the first nonwoven filter material is cellulose acetate.

Advantageously, the second nonwoven filter material comprises bleached and/or unbleached cellulose acetate. In particular, the second nonwoven filter material is cellulose acetate.

Preferably, the porous filter material contains activated carbon. Advantageously, the porous filter material is activated carbon. In particular, the activated carbon is present in the second section in the form of granulated material. The granulated material has a mesh size that is preferably between 0.2 and 5 mm, particularly preferably between 0.5 and 2 mm, yet more preferably substantially 1 mm. The granulated material is preferably an 18×35 mesh granulated material. The porous filter material has a pore size volume that is preferably between 0.2 and 2 $cm^3/g$ total pore volume, particularly preferably between 0.7 and 0.8 $cm^3/g$ total pore volume. The activated carbon preferably has a carbon tetrachloride activity (CTC) of at least 40, in particular substantially 50.

The invention further relates to a smoking article, in particular a tobacco cigarette, a cannabis cigarette or a tobacco-cannabis cigarette. The smoking article has a substance that can be smoked. The smoking article has a device for filtering smoke in accordance with any of the embodiments described herein. Preferably, the first portion of the device faces the substance that can be smoked. This means that the first portion is distal to the mouth and the fourth portion is proximal to the mouth. The smoking article preferably comprises a smoking article wrap. The device and the substance that can be smoked are contained in the smoking article. The substance that can be smoked is preferably tobacco, cannabis, or a mixture thereof.

BRIEF DESCRIPTION OF THE FIGURES

The invention shall now be explained in detail below with the aid of a preferred exemplary embodiment as shown in the drawings, which are not limiting in any way.

DETAILED DESCRIPTION

Figure 2:
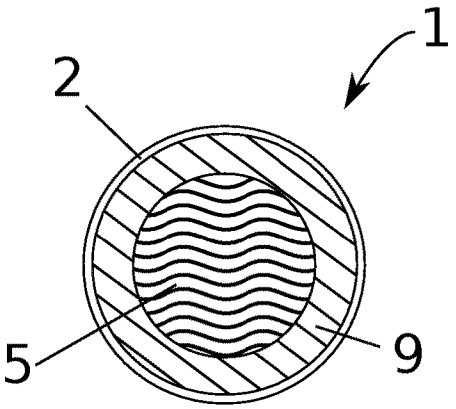
FIG. 2 schematically shows the same embodiment of the device as FIG. 1, from the front.
Figure 1:
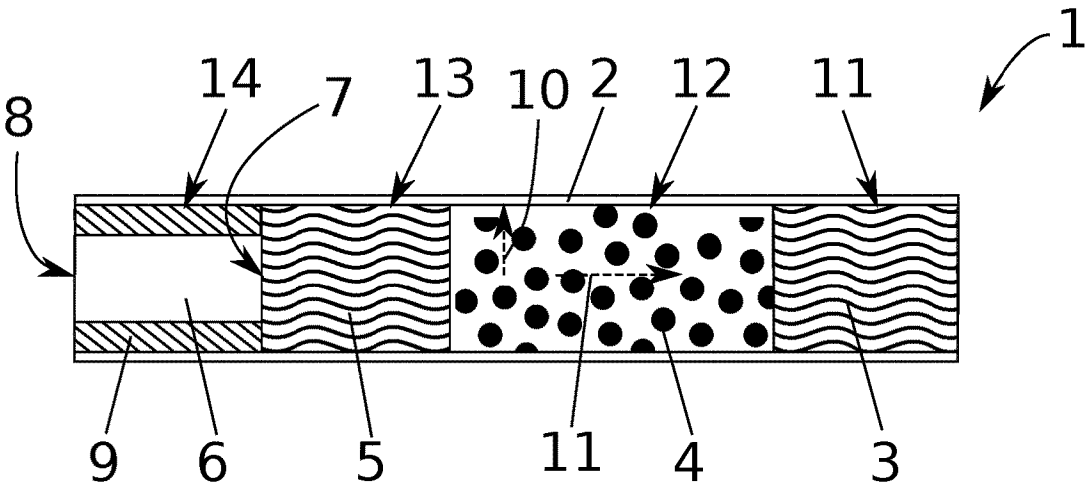
FIG. 1 schematically shows a preferred embodiment of a device for filtering smoke in a sectional view.

FIG. 1 schematically shows a preferred embodiment of a device 1 for filtering smoke in a sectional view. FIG. 2 schematically shows the same embodiment from the front. The device 1 has a wrap 2. A first section 11, a second section 12, a third section 13 and a fourth section 14 are provided in the wrap 2. The second section 12 is disposed between the first section 11 and the third section 13. The third section 13 is disposed between the second section 12 and the fourth section 14. FIG. 2 shows the device 1 from a direction extending from the first section 11 to the fourth section 14. The wrap 2 bounds the first section 11, the second section 12, the third section 13 and the fourth section 14 in a radial direction 10. The radial direction 10 is indicated by a dashed arrow. The axial direction 11 (i.e. longitudinal direction) of the wrap 2 and the device 1 is orthogonal to the radial direction 10 and is also indicated by a dashed arrow.

A first nonwoven filter material 3 is provided in the first section 11. In particular, the first nonwoven filter material 3 is cellulose acetate. A porous filter material 4 is provided in the second section 12. In particular, the porous filter material 4 is activated carbon in granulated form. A second nonwoven filter material 5 is provided in the third section 13. In particular, the second nonwoven filter material 5 is cellulose acetate.

The fourth section 14 is disposed in a manner such that, during flow through the wrap 2 (in particular substantially in the axial direction 11), a pressure drop over the fourth section 14 is lower than a pressure drop over the third section 13. Thus, on the one hand, good filtration performance is obtained, but on the other hand, the passage through the device 1 is not made too difficult. Furthermore, cooling of smoke that is drawn through is obtained in the fourth section 14.

The fourth section 14 has a support element 9 that supports the wrap 2 in the region of the fourth section 14.

The support element 9 is in the form of a hollow cylinder and extends along the entire length of the fourth section 14. The hole of the hollow cylinder forms a cavity 6 that extends from the end 7 of the fourth section 14 facing the third section 13 to the end 8 of the fourth section 14 facing away from the third section 13.

The first nonwoven filter material 3 and the second nonwoven filter material 5 are in fact shown with similar hatching. However, the second nonwoven filter material 3 has a lower density than the first nonwoven filter material 5. Thus, a pressure drop over the first section 11 is also greater than the pressure drop over the third section 13. Consequently, the first nonwoven filter material 3 can filter the smoke particularly well, whereas the second nonwoven filter material 5 is primarily intended to filter out the activated carbon dust and to remove as few flavor substances as possible from the smoke.

Figure 3:
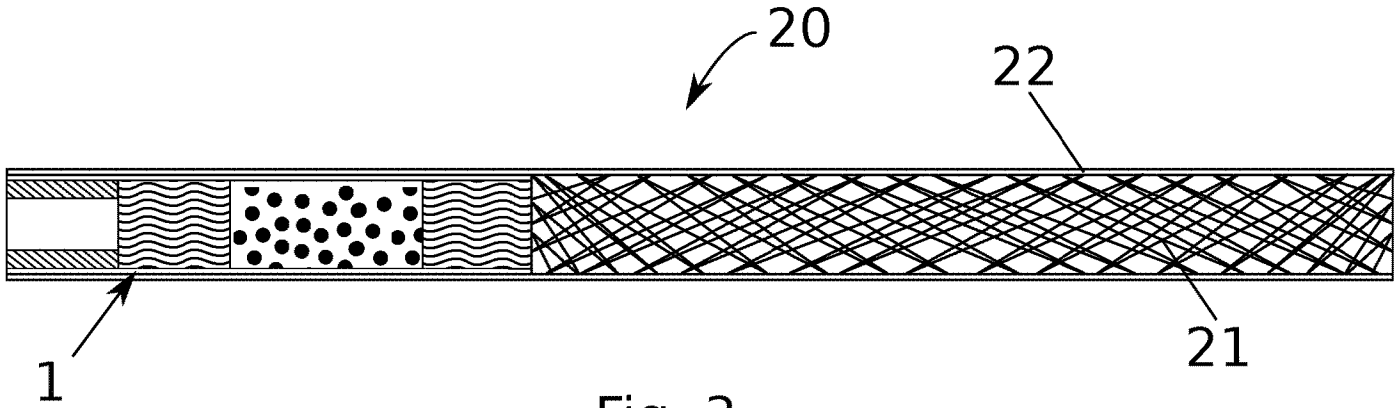
FIG. 3 schematically shows a preferred embodiment of a smoking article in a sectional view.

FIG. 3 schematically shows a preferred embodiment of a smoking article 20 in a sectional view. The smoking article 20 has, in a smoking article wrap 22, the device 1 for filtering smoke and a substance 21 that can be smoked. Here, the first section 11 of the device 1 is disposed facing the substance 21 that can be smoked, i.e. remote from the mouth, and the fourth section 14 of the device 1 is disposed facing away from the substance 21 that can be smoked, i.e. close to the mouth.

The invention claimed is:

1. A device for filtering smoke, with a wrap formed by a filter wrap paper, wherein at least a first section, a second section and a third section are provided in the wrap, wherein the second section is disposed between the first section and the third section, wherein a first nonwoven filter material is provided in the first section;

a porous filter material is provided in the second section;

and a second nonwoven filter material is provided in the third section;

wherein a fourth section is provided in the wrap, wherein the third section is disposed between the second section and the fourth section, and wherein the fourth section is configured in a manner such that a pressure drop over the fourth section is smaller than a pressure drop over the third section as a flow of smoke passes through the wrap from the first section to the fourth section, wherein the fourth section has a support element that supports the wrap in the region of the fourth section;

wherein the porous filter material is activated carbon;

wherein the first section and the third section are disposed in a manner such that a pressure drop over the first section is greater than the pressure drop over the third section as the flow of smoke passes through the wrap, wherein the pressure drop over the first section is at least 1.5 times the pressure drop over the third section; and the first nonwoven filter material has a greater density than the second nonwoven filter material, wherein the density of the first nonwoven filter material is more than 1.4 times the density of the second nonwoven material.

2. Device according to claim 1, wherein the fourth section has a cavity that extends from the end of the fourth section facing the third section to the end of the fourth section facing away from the third section.

3. Device according to claim 1, wherein the support element is in the form of a hollow cylinder.

4. Device according to claim 1, wherein the fourth section has a length in the longitudinal direction of the device of at least 2 mm.

5. Device according to claim 4, wherein the fourth section has a length in the longitudinal direction of the device of at least 4 mm.

6. Device according to claim 1, wherein an inner wrap is provided in the wrap that extends over the first section, the second section and the third section, wherein the first nonwoven filter material, the porous filter material and the second nonwoven filter material are disposed inside the inner wrap, wherein the first nonwoven filter material and the second nonwoven filter material are at least partially circumferentially bonded to the inner wrap.

7. Device according to claim 1, wherein the first section and the third section are disposed in a manner such that a pressure drop per unit length in the first section is greater than a pressure drop per unit length in the third section as the flow of smoke passes through the wrap.

8. Device according to claim 1, wherein the second section contains between 60 mg and 140 mg of the porous filter material.

9. Device according to claim 1, wherein the first nonwoven filter material contains cellulose acetate.

10. Device according to claim 1, wherein the second nonwoven filter material contains cellulose acetate.

11. A smoking article, comprising a substance that can be smoked, wherein the smoking article comprises a device according to claim 1, and wherein the first section of the device faces the substance that can be smoked.

12. Device according to claim 11, wherein the fourth section has a length in the longitudinal direction of the device of at least 6 mm.

13. Device according to claim 1, wherein the pressure drop over the first section is at least 1.8 times the pressure drop over the third section.

14. Device according to claim 1, wherein the second section contains between 75 mg and 125 mg of the porous filter material.

15. Device according to claim 1, wherein the second section contains between 85 mg and 115 mg of the porous filter material.

16. Smoking article according to claim 11, wherein the smoking article is a tobacco cigarette, cannabis cigarette or tobacco-cannabis cigarette.

* * * * *